US005172663A

United States Patent [19]

Fujiwara

[11] Patent Number: 5,172,663

[45] Date of Patent: Dec. 22, 1992

[54] VALVE GEAR LUBRICATING DEVICE OF ENGINE

[75] Inventor: Hideo Fujiwara, Shizuoka, Japan

[73] Assignee: Suzuki Motor Corporation, Hamamatsu, Japan

[21] Appl. No.: 821,695

[22] Filed: Jan. 16, 1992

[30] Foreign Application Priority Data

Jan. 31, 1991 [JP] Japan ..... 3-32183

[51] Int. Cl.[5] ..... F01L 9/10

[52] U.S. Cl. ..... 123/90.34; 123/90.36; 123/90.46

[58] Field of Search ..... 123/90.33, 90.34, 90.35, 123/90.36, 90.39, 90.46; 74/519, 559

[56] References Cited

U.S. PATENT DOCUMENTS

| | | | |
|---|---|---|---|
| 3,314,404 | 4/1967 | Thompson | 123/90.34 |
| 3,502,058 | 3/1970 | Thompson | 123/90.34 |
| 3,855,981 | 12/1974 | Loon | 123/90.34 |
| 4,589,383 | 5/1986 | Showalter | 123/90.46 |
| 4,624,223 | 11/1986 | Wherry et al. | 123/90.36 |
| 4,644,914 | 2/1987 | Morita et al. | 123/90.36 |
| 4,815,424 | 3/1989 | Buuck et al. | 123/90.46 |

FOREIGN PATENT DOCUMENTS

| | | | |
|---|---|---|---|
| 88809 | 5/1985 | Japan | 123/90.34 |
| 1-136611 | 9/1989 | Japan . | |

*Primary Examiner*—E. Rollins Cross
*Assistant Examiner*—Weilun Lo
*Attorney, Agent, or Firm*—Flynn, Thiel, Boutell & Tanis

[57] ABSTRACT

A valve gear lubricating device is provided for lubricating a valve gear of an engine including a cam shaft which is rotatable by the engine, and a rocker arm oscillated by a cam disposed on the cam shaft. A slide contact portion is formed on one end of the rocker arm and is slideably contactable with the cam. A hydraulic valve adjuster is mounted on the other end of the rocker arm and is adapted to adjust a valve clearance of the engine. The rocker arm is provided with a mixture passage through which flows a mixture of air and lubricating oil discharged from the hydraulic valve adjuster. A terminal end of the mixture passage opens close to a moving part of the valve gear.

3 Claims, 4 Drawing Sheets

VALVE GEAR LUBRICATING DEVICE OF ENGINE

FIELD OF THE INVENTION

This invention relates to a valve gear lubricating device of an engine, and particularly to a valve gear lubricating device of an engine which is capable of bringing a mixture of air and lubricating oil, as discharged from a hydraulic valve adjuster mounted on a rocker arm for adjusting a valve clearance, into colliding contact with a moving part of the valve gear without dispersing the mixture uselessly.

BACKGROUND OF THE INVENTION

An engine, particularly a 4-cycle engine, is equipped with an intake valve and an outlet valve for the purposes of taking air into a combustion chamber and discharging exhaust therefrom. As for systems of these valves, there are a side valve system, an overhead valve system, etc. Some of the valve gears for actuating these valves, for example, those for actuating valves of an overhead valve system, include a seesaw type rocker arm or a swing type rocker arm.

A seesaw type rocker arm is oscillatably supported at an intermediate portion thereof by a rocker shaft. The seesaw type rocker arm is slide contacted at one end thereof with a cam of a cam shaft and abutted at the other end against a valve stem. On the other hand, a swing type rocker arm is supported at one end thereof by a pivot portion. The swing type rocker arm is slide contacted at an intermediate portion thereof with a cam of a cam shaft and abutted at the other end against a valve stem. Some of the valve gears for actuating an overhead type valve are of direct drive type, in which a valve stem is directly driven by a cam of a cam shaft.

One example of the valve gears mentioned above are shown in FIGS. 4 through 6. In FIG. 4, the numeral 202 denotes an engine, and 204, a cylinder head. The cylinder head 204 of the engine 202 has a combustion chamber 206 defined by a cylinder block and a piston (not shown), and an intake port 208 and an outlet port 210 communicating with this combustion chamber 206. An intake valve stem 216 and an outlet valve stem 218 of an intake valve 212 and an outlet valve 214 for opening and closing the intake port 208 and the outlet port 210 are provided with an intake valve spring 220 and an outlet valve spring 222, and also with an intake valve stem abutment portion 224 and an outlet valve stem abutment portion 226, respectively.

In a valve gear 230 disposed in a valve gear chamber 228 of the cylinder head 204, a cam shaft 232 to be rotated by the engine 202 is supported on the cylinder head 204 through a cam cap 234, and a swing type intake rocker arm 240 and a seesaw type outlet rocker arm 242 are actuated by an intake cam 236 and an outlet cam 238 mounted on this cam shaft 232. The swing type intake rocker arm 240 is provided at one end thereof with a portion 246 swingably supported by a hydraulic valve adjuster 244 for adjusting a valve clearance. The arm 240 is provided at an intermediate portion thereof with a slide contact portion 248 to be slide contacted with the intake cam 236, and at the other end thereof with an abutment portion 250 to be abutted against the intake valve stem abutment portion 224. The seesaw type outlet rocker arm 242 is provided at an intermediate portion thereof with a portion 254 oscillatably supported by a rocker shaft 252. The arm 242 is provided at one end thereof with a slide contact portion 256 to be slide contacted with the outlet cam 238, and at the other end thereof with a hydraulic valve adjuster 258 for adjusting a valve clearance.

In FIG. 4, the numeral 260 denotes a head cover. The head cover 260 is provided with a breather chamber 262 defined therein in such a manner as to be opposite the valve gear chamber 228 and also with a breather pipe 264 through which this breather chamber 262 is communicated with an intake system.

In the valve gear 230 of the engine 202, the intake rocker arm 240 and the outlet rocker arm 242 are actuated for oscillation by the intake cam 236 and the outlet cam 238 of the cam shaft 232 rotated by the engine 202. The intake rocker arm 240 is oscillated by the intake cam 236 of the cam shaft 232 about the hydraulic valve adjuster 244 disposed at one end thereof and moves the intake valve stem 216 in the axial direction with the abutment portion 250 disposed on the other end thereof, to thereby open and close the intake valve 212. On the other hand, the outlet rocker arm 242 of the valve gear 230 is oscillated by the outlet cam 238 of the cam shaft 232 about the rocker shaft 252 disposed at an intermediate portion thereof and moves the outlet valve stem 218 in the axial direction with the hydraulic valve adjuster 258 disposed on the other end thereof, to thereby open and close the outlet valve 214 disposed at the outlet port 210.

One example of the valve gear mentioned above is disclosed in Japanese Utility Model Early Laid-open Publication No. Hei 1-136611. The one disclosed in this publication is constituted such that a swing type rocker arm is swingably supported at one end thereof by a hydraulic valve adjuster, the arm being slide contacted at a roller on an intermediate portion thereof with a cam of a cam shaft and abutted at the other end thereof against a valve stem abutment portion, wherein a hole for discharging a mixture of air and lubricating oil formed in a plunger of the hydraulic valve adjuster is formed in such a manner as to be directed in a direction of the abutting surfaces between the cam of the cam shaft and the roller.

In FIG. 4, the hydraulic valve adjuster 244 pivotally supporting the one end of the intake rocker arm 240 and the hydraulic valve adjuster 258 abutted at the other end of the outlet rocker arm 242 against the outlet valve stem 218 are operated by being supplied with lubricating oil through lubricating oil paths 266 and 268, respectively, and they, in turn, discharge a mixture of air and lubricating oil into the valve gear chamber 228 through discharging holes 270 and 272, respectively.

However, in the conventional arrangement, when a mixture of air and lubricating oil is discharged into the valve gear chamber 228, the mixture reaches so far as the breather chamber 262 of the head cover 260 with the result that the air and lubricating oil are discharged through the breather pipe 264 without being separated into air and liquid. Furthermore, when the mixture is discharged without being separated into air and liquid, lubricating performance is lowered owing to the resultant decrease in lubricating oil in chamber 228.

Therefore, the system in the above-mentioned publication attempts to improve the lubricating performance by forming the hole for discharging the mixture in the plunger of the hydraulic valve adjuster in such a manner as to be directed in the direction of the abutting surfaces between the cam of the cam shaft and the roller of the swing type rocker arm and discharging the mixture toward the abutting surfaces. However, this particular arrangement has problems in that the distance from the discharging hole to the abutting surfaces between the cam and the roller is long because the hole for discharging the mixture is formed in the plunger of the hydraulic valve adjuster. Therefore, the mixture is uselessly dispersed before it reaches the abutting surfaces and cannot be effectively brought into contact with the abutting surfaces. As a result, favorable lubrication is unobtainable. In addition, the mixture is not adequately separated into air and liquid.

As shown in FIGS. 5 and 6, in case the hydraulic valve adjuster 258 for adjusting valve clearance is disposed at the other end of the seesaw type outlet rocker arm 242, heretofore, the terminal end of the hole 272 for discharging the mixture is formed in such a manner as to be directed upwardly within the valve gear chamber 228. Accordingly, this also had inconveniences, as in the system of the above publication. For example, since the distances from the discharging hole 272 to the outlet cam 238 and to the slide contact portion 256 to be slide contacted with the outlet cam 238 are long, the mixture is uselessly dispersed before it reaches the outlet cam 238 and the slide contact portion 256, and the mixture cannot be brought into contact with the outlet cam 238 and the slide contact portion 256 sufficiently. As a result, favorable lubrication is unobtainable. In addition, the mixture is not adequately separated into air and liquid.

One object of the present invention is to realize a valve gear lubricating device of an engine which is capable of bringing a mixture of air and lubricating oil discharged from a hydraulic valve adjuster into colliding contact with a moving part of a valve gear without uselessly dispersing the mixture, thereby separating the mixture into air and lubricating oil by means of this colliding contact with the moving part, favorably lubricating the moving part of the valve gear by such separated lubricating oil, preventing the lubricating oil from being discharged, and avoiding deterioration of lubricating performance.

According to the present invention, there is provided, in an attempt to obviate the above inconveniences and achieve the above object, a valve gear lubricating device for lubricating a valve gear of an engine, including a cam shaft being rotated by said engine, a rocker arm oscillated by a cam of said cam shaft, a slide contact portion formed on one end of said rocker arm and being slide contacted with said cam, and a hydraulic valve adjuster mounted on the other end of the rocker arm and adapted to adjust a valve clearance of said engine, wherein said valve gear lubricating device is characterized in that said rocker arm is provided with a mixture passage through which a mixture of air and lubricating oil discharged from said hydraulic valve adjuster flows, said mixture passage being opened up at a terminal end thereof proximate to a moving portion of said valve gear.

According to the constitution of the present invention, by virtue of such arrangement wherein the mixture passage for carrying therethrough the mixture of air and lubricating oil discharged from the hydraulic valve adjuster is mounted on the rocker arm and opens at a terminal end thereof proximate to the moving part of the valve gear, the mixture can be brought into colliding contact with the moving part of the valve gear without useless dispersing thereof.

BRIEF DESCRIPTION OF THE DRAWINGS

Next, one embodiment of the present invention will be described in detail with references to the drawings, in which.

DETAILED DESCRIPTION

Figure 1:
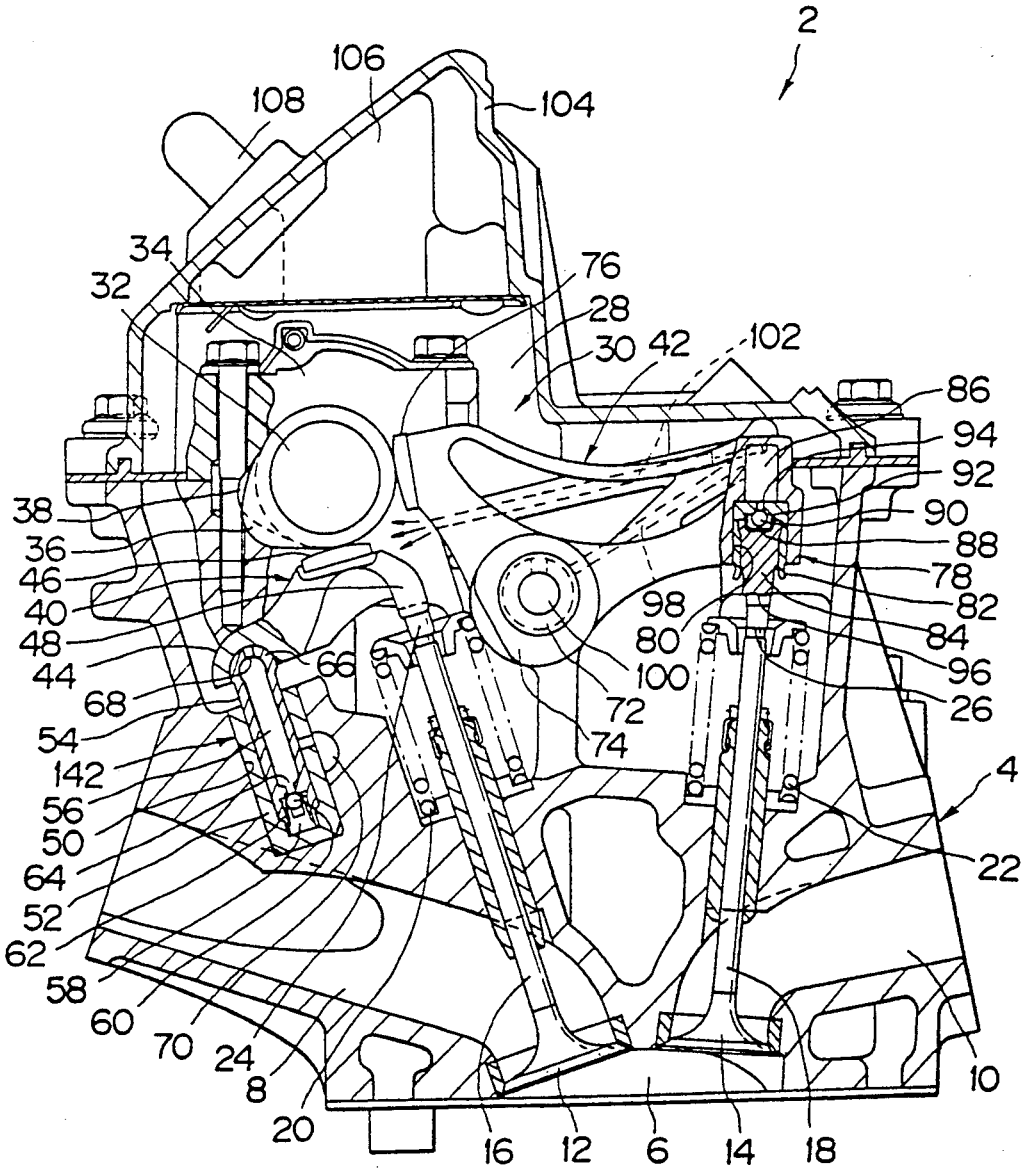
FIG. 1 is a sectional view of a valve gear lubricating device of an engine showing one embodiment of the present invention.
Figure 2:
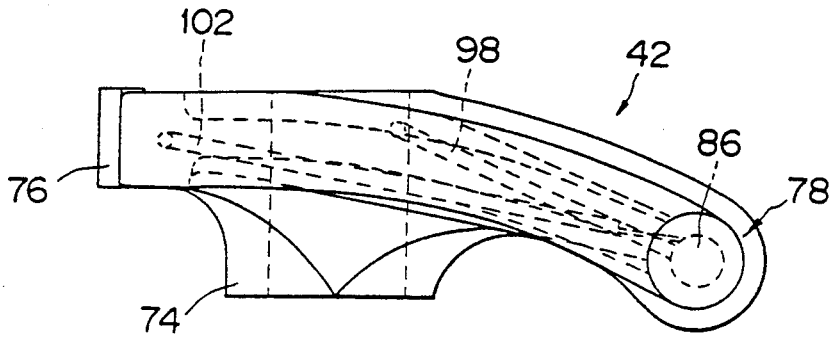
FIG. 2 is a plan view of an outlet rocker arm of FIG. 1.
Figure 3:
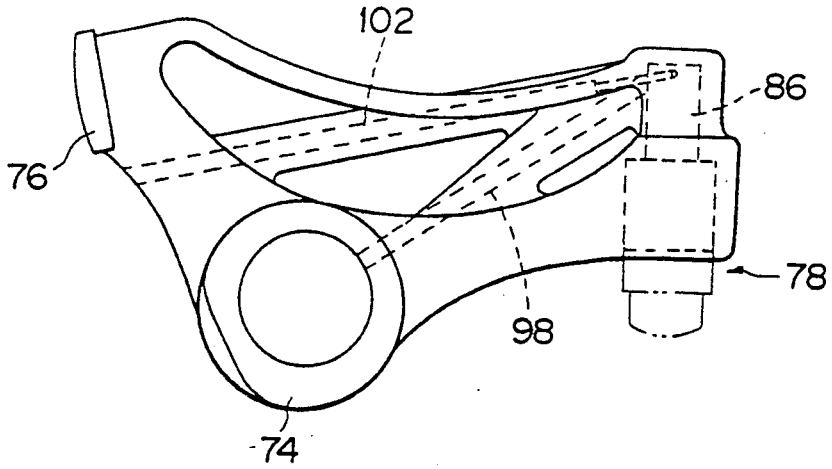
FIG. 3 is a front view of the outlet rocker arm of FIG. 1.
Figure 4:
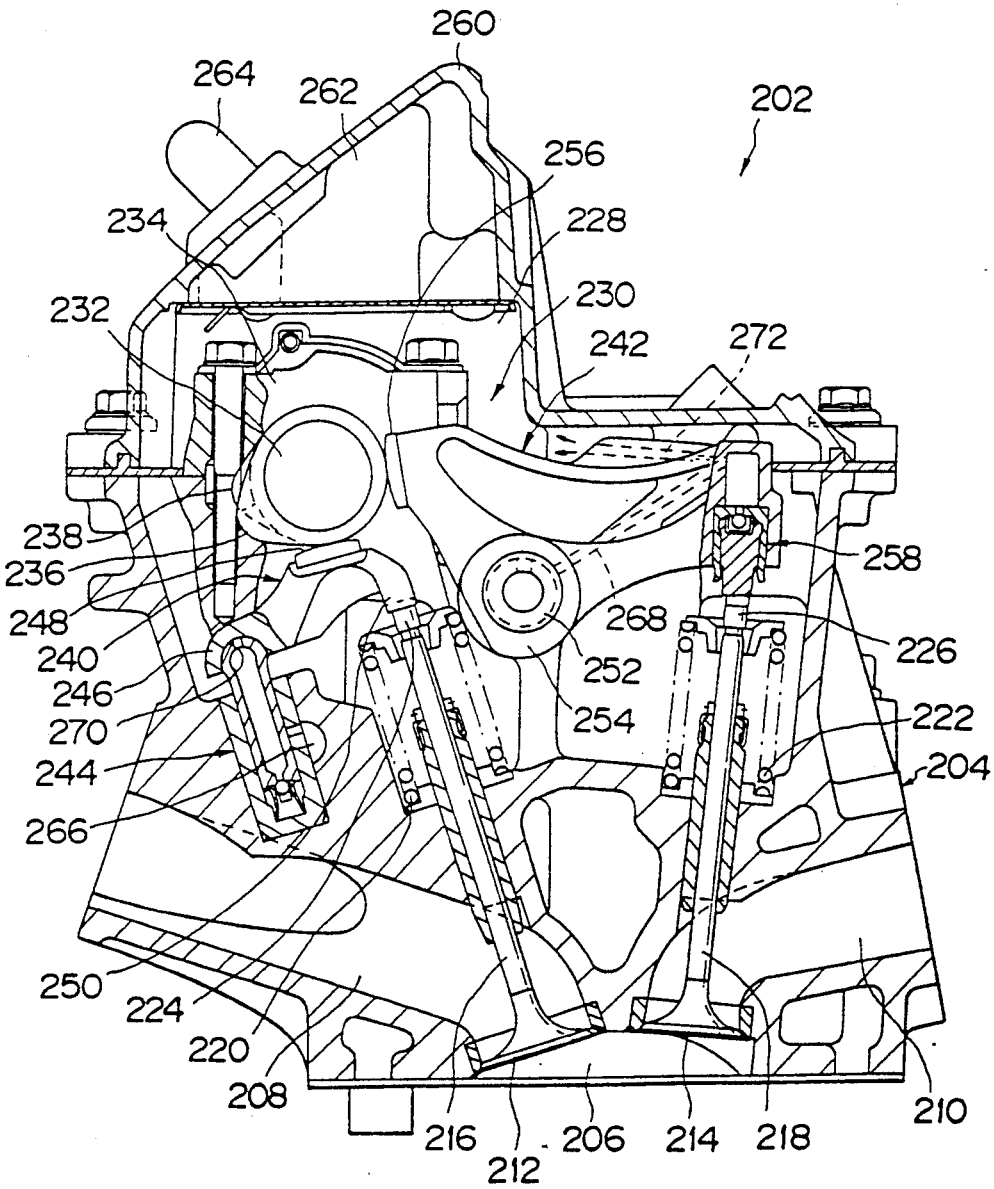
FIG. 4 PRIOR ART
FIG. 4 is a sectional view of a prior art valve gear lubricating device.
Figure 5:
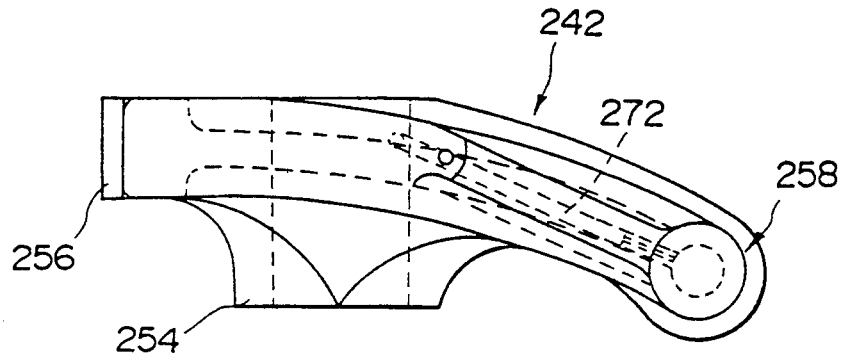
FIG. 5 PRIOR ART
FIG. 5 is a plan view of a prior art outlet rocker arm of FIG. 4.
Figure 6:
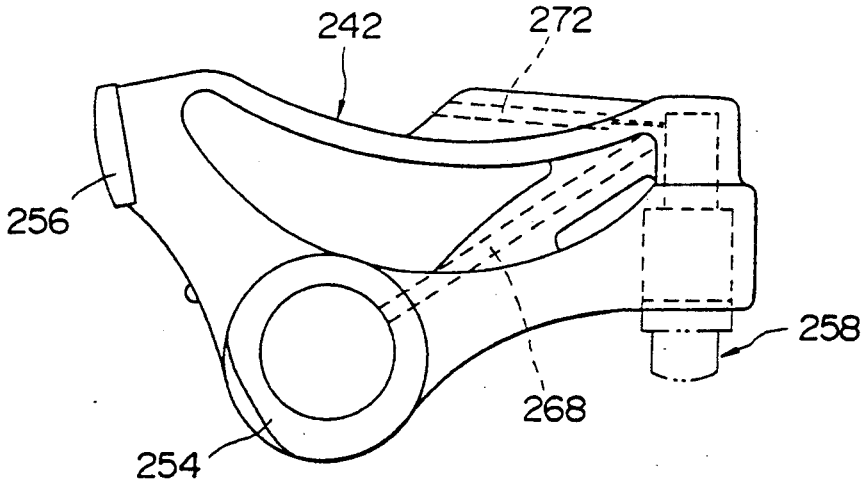
FIG. 6 PRIOR ART
FIG. 6 is a front view of the prior art outlet rocker arm of FIG. 4.

FIGS. 1 through 3 show one embodiment of the present invention. In FIG. 1, the numeral 2 denotes an engine, and 4, a cylinder head. The cylinder head 4 of the engine 2 is provided with a combustion chamber 6 defined by a cylinder block and a piston (not shown), and further with an intake port 8 and an outlet port 10 which are in communication with this combustion chamber 6. An intake valve stem 16 and an outlet valve stem 18 of an intake valve 12 and an outlet valve 14 for opening and closing the intake port 8 and the outlet port 10 are provided with an intake valve spring 20 and an outlet valve spring 22, and further with an intake valve stem abutment portion 24 and an outlet valve stem abutment portion 26, respectively.

A valve gear 30 disposed within a valve gear chamber 28 of the cylinder head 4 has a cam shaft 32 which is rotated by the engine and supported by the cylinder head through a cam cap 34. A swing type intake rocker arm 40 and a seesaw type outlet rocker arm 42 are actuated by an intake cam 36 and an outlet cam 38, respectively, which are mounted on this cam shaft 32. The swing type rocker arm 40 is provided at one end thereof with a pivotal support portion 44 pivotally supported by a hydraulic valve adjuster 142 for adjusting a valve clearance, and at an intermediate portion thereof with a slide contact portion 46 to be slide contacted with the intake cam 36. The arm 40 is provided at the other end thereof with an abutment portion 48 to be abutted against the intake valve stem abutment portion 24.

The hydraulic valve adjuster 142 comprises a body 52 held in a holding hole 50 of the cylinder head 4, a plunger 54 disposed within this body 52, an oil reserving chamber 56 formed within this plunger 54, a pressure oil chamber 58 formed within the body 52, and a ball 60 and a spring 62 disposed within this pressure oil chamber 58. The plunger 54 is provided at a basal (i.e., lower) portion thereof with a communication hole 64 through which the oil reserving chamber 56 and the pressure oil chamber 58 are communicated with each other, and at a distal (i.e., upper) end thereof with a pivot portion 66 for pivotally supporting the pivotal support portion 44. This pivot portion 66 is provided with a hole 68 for discharging a mixture of air and lubricating oil. The cylinder head 4 is provided with a lubricating oil passage 70 communicating with the oil reserving chamber 56.

The seesaw type outlet rocker arm 42 is provided at an intermediate portion thereof with a portion 74 swingably supported by a rocker shaft 72 and at one end thereof with a slide contact portion 76 to be slide contacted with the outlet cam 38. The arm 42 is provided at the other end thereof with a hydraulic valve adjuster 78 for adjusting a valve clearance.

The hydraulic valve adjuster 78 comprises a body 82 held in a holding hole 80 formed in the outlet rocker arm 42, a plunger 84 disposed within this body 82, an oil reserving chamber 86 formed within the outlet rocker arm 42, a pressure oil chamber 88 formed within the body 82, and a ball 90 and a spring 92 disposed within this pressure oil chamber 88. The body 82 is provided at a basal (i.e., lower) portion thereof with a communication hole 94 through which the oil reserving chamber 86 is communicated with the pressure oil chamber 88. The plunger 84 is provided at a distal (i.e., lower) end thereof with an abutment portion 96 to be abutted against the outlet valve stem abutment portion 26. The outlet rocker arm 42 is provided with a lubricating oil passage 98 communicating with the oil reserving chamber 86. This lubricating oil passage 98 is in communication with a lubricating oil supply passage 100 provided in the rocker shaft 72.

The outlet rocker arm 42, as shown in FIGS. 2 and 3, is provided with a mixture passage 102 communicated with the oil reserving chamber 86 of the hydraulic valve adjuster 78 and through which a mixture of air and lubricating oil flows. This mixture passage 102 opens at its terminal end proximate to the outlet cam 38 of the cam shaft 32 and to the slide contact portion 76 of the outlet rocker arm 42. That is, the mixture passage 102 opens at its terminal end proximal to and directed to the slide contact parts of the outlet cam 38 and the side contact portion 76, so that the discharged mixture will contact the outlet cam 38 and the slide contact portion 76 without being uselessly dispersed.

In FIG. 1, the numeral 104 denotes a head cover. The head cover 104 is provided with a breather chamber 106 defined therein opposite to the valve gear chamber 28 and with a breather pipe 108 through which this breather chamber 106 is communicated with an intake system.

In the valve gear 30 of the engine 2, the intake rocker arm 40 and the outlet rocker arm 42 are actuated for oscillation by the intake cam 36 and the outlet cam 38 of the cam shaft 32 which is rotated by the engine 2. The intake rocker arm 40 is oscillated by the intake cam 36 of the cam shaft 32 about the pivot portion 66 of the hydraulic valve adjuster 142 disposed at one end thereof. The intake rocker arm 40 moves the intake valve stem 16 in the axial direction through the abutment portion 48 provided at the other end thereof in order to open and close the intake valve 12 which is provided in the intake port 8. On the other hand, the outlet rocker arm 42 is oscillated by the outlet cam 38 of the cam shaft 32 about the rocker shaft 72 disposed at an intermediate portion thereof. The outlet rocker arm 42 moves the outlet valve stem is in the axial direction through the hydraulic valve adjuster 78 disposed at its other end in order to open and close the outlet valve 14 which is provided in the outlet port 10.

In such valve gear 30, the outlet rocker arm 42 is provided with the mixture passage 102 for the mixture of air and lubricating oil, communicated with the oil reserving chamber 86 of the hydraulic valve adjuster 78. This mixture passage 102 opens at its terminal end proximate to the slide contacting portions of the outlet cam 38 and the slide contact portion 76, so that the mixture of air and lubricating oil discharged from the oil reserving chamber 86 will be brought into colliding contact with the outlet cam 38 and the slide contact portion 76 without being uselessly dispersed.

Owing to the foregoing, the mixture can be separated into air and lubricating oil by being brought into colliding contact with the outlet cam 38 and the slide contact portion 76. As a result, the slide contacting portions of the outlet cam 38 and the slide contact portion 76 can be lubricated favorably by such separated lubricating oil. In addition, the lubricating oil can be prevented from being discharged from the breather pipe 108 by means of separation of the mixture into air and lubricating oil, and deterioration of lubricating performance can be avoided by means of preventing the decrease of the lubricating oil.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a valve gear lubricating device for lubricating a valve gear of an engine including a cam shaft which is rotatable by said engine, a rocker arm oscillated by a cam of said cam shaft, a slide contact portion formed on one end of said rocker arm and being slidably contactable with said cam of said cam shaft, and a hydraulic valve adjuster mounted on the other end of said rocker arm and adapted to adjust a valve clearance of said engine, the improvement wherein said rocker arm is provided with a mixture passage through which flows a mixture of air and lubricating oil discharged from said hydraulic valve adjuster, said mixture passage opening adjacent said one end of said rocker arm proximate to a moving portion of said valve gear.

2. A device according to claim 1, wherein said terminal end of said mixture passage is disposed closely adjacent said slide contact portion of said rocker arm so that said mixture passage outputs said mixture of air and oil closely adjacent to said slide contact portion.

3. A device according to claim 2, wherein said mixture passage has a length which is approximately equal to a distance between said ends of said rocker arm.

* * * * *